US005316582A

United States Patent [19]

Dübel

[11] Patent Number: 5,316,582

[45] Date of Patent: May 31, 1994

[54] APPARATUS FOR CONTINUOUSLY APPLYING A LIQUID TO A WEB

[75] Inventor: Friedrich Dübel, Krefeld, Fed. Rep. of Germany

[73] Assignee: Wako Walzen Konstruktion System GmbH, Krefeld, Fed. Rep. of Germany

[21] Appl. No.: 948,210

[22] Filed: Sep. 21, 1992

[30] Foreign Application Priority Data

Sep. 20, 1991 [DE] Fed. Rep. of Germany ... 9111789[U]

[51] Int. Cl.[5] ..... B05B 15/04; B05C 5/00

[52] U.S. Cl. ..... 118/301; 118/213; 118/261; 118/325; 118/320; 118/406; 427/282

[58] Field of Search ..... 118/412, 413, 301, 406, 118/213, 261, 300, 320, 325; 427/282, 421

[56] References Cited

U.S. PATENT DOCUMENTS 4,626,452 12/1986 Poterala ..... 118/415 X

FOREIGN PATENT DOCUMENTS 175956 12/1950 Australia .

3146828 12/1983 Fed. Rep. of Germany .

*Primary Examiner*—David A. Simmons

*Assistant Examiner*—M. Curtis Mayes

*Attorney, Agent, or Firm*—Herbert Dubno; Andrew Wilford

[57] ABSTRACT

An apparatus for continuously applying a liquid to a web has a nozzle having an elongated opening and directed at the web, a strip slidable steplessly along the opening of the nozzle to vary the length thereof, and a foraminous transfer screen displaceable transversely between the web and the nozzle opening and having a back face turned toward the nozzle and a front face turned toward the web. Back and front troughs engage the respective faces of the screen and define therewith back and front chambers while respective back and front steplessly displaceable pistons in each of the troughs engage the respective screen faces and each define an end wall for the respective chamber. The chambers are filled with a treatment liquid so that the liquid will wet the respective face of the screen over an area determined by the position of the pistons and a gas is supplied to the nozzle to blow the gas through the nozzle opening and through the screen and thereby transfer liquid carried by the screen to the web. A controller connected to the pistons and to the strip generally synchronously varies the lengths of the chambers and nozzle opening.

10 Claims, 4 Drawing Sheets

APPARATUS FOR CONTINUOUSLY APPLYING A LIQUID TO A WEB

FIELD OF THE INVENTION

The present invention relates to an apparatus for continuously applying a liquid to a web. More particularly this invention concerns such a system which applies a thin film of the liquid to a continuously moving web.

BACKGROUND OF THE INVENTION

It is known to apply a liquid to a web by first passing a foraminous screen through a bath of the liquid and then blowing the liquid with air or steam from the screen onto the web by means of a slot nozzle whose opening is arranged transverse to the displacement direction of the web past the nozzle. In this manner one can obtain a very even coating in a high-speed process without having to worry about the nozzle clogging. The screen can be formed as a foraminous drum (see Austrian patent document 175,956) or a loop (see German patent document 3,146,828) that dips into a bath of the liquid.

In order to be able in a production operation to vary the width of the strip of liquid, typically an adhesive, that is applied to the web, it has been suggested in German patent document 4,001,452 to set up the bath so that it is subdivided into individual compartments that can be selectively filled or emptied. Thus only a portion of the web need be wetted. Such an arrangement does allow the system to be adapted somewhat in a stepwise manner to different web widths, but still must almost always be set somewhat wider than the workpiece width so areas of the screen extending past the workpiece edges will become clogged.

OBJECTS OF THE INVENTION

It is therefore an object of the present invention to provide an improved apparatus for applying a liquid to a web.

Another object is the provision of such an improved apparatus for applying a liquid to a web which overcomes the above-given disadvantages, that is which allows accurate and stepless adjustment of the width of the strip of liquid sprayed on the web.

SUMMARY OF THE INVENTION

An apparatus for continuously applying a liquid to a web has according to the invention a nozzle having an elongated opening and directed at the web, a strip slidable steplessly along the opening of the nozzle to vary the length thereof, and a foraminous transfer screen displaceable transversely between the web and the nozzle opening and having a back face turned toward the nozzle and a front face turned toward the web. Back and front troughs engage the respective faces of the screen and define therewith back and front chambers while respective back and front steplessly displaceable pistons in each of the troughs engage the respective screen faces and each define an end wall for the respective chamber. The chambers are filled with a treatment liquid so that the liquid will wet the respective face of the screen over an area determined by the position of the pistons and a gas is supplied to the nozzle to blow the gas through the nozzle opening and through the screen and thereby transfer liquid carried by the screen to the web. A controller connected to the pistons and to the strip generally synchronously varies the lengths of the chambers and nozzle opening.

Thus with this system only a strip of the screen need be wetted and vehicle air is only blown through this strip, making the system very efficient. The width of this strip can be varied steplessly so it can be set to correspond exactly to the width of the workpiece web.

According to a feature of the invention each of the troughs is provided with two such pistons defining respective end walls and the nozzle is also provided with two such strips. Respective transmission means connected between the pistons of each chamber and between the strips longitudinally oppositely move the respective pistons and strips. These transmissions are all interconnected for substantially synchronous movement of the pistons and strips and they include a front threaded spindle engaging through the pistons of the front trough and a rear threaded spindle engaging through the pistons of the rear trough. The nozzle is formed with a guide slot in which the strips are displaceable and the transmissions include a threaded strip spindle operatively engaged with the strips. A sensor for the width of the workpiece can coact with the controller for automatically setting nozzle and trough length.

Respective front and back scrapers in the front and rear trough engage the respective faces of the screen. This screen is formed as an endless loop and a drive is provided for continuously advancing the screen in a screen-travel direction generally parallel to the web past the nozzle. The scrapers are offset from one another relative to the screen-travel direction and the troughs are immediately upstream of the nozzle in the screen-travel direction.

The chambers are maintained full to predetermined respective depths with the liquid and longitudinally extending scrapers flank the nozzle and press the back face of the screen against the nozzle. Thus the nozzle itself scrapes off an excess liquid.

BRIEF DESCRIPTION OF THE DRAWING

The above and other objects, features, and advantages will become more readily apparent from the following, reference being made to the accompanying drawing in which.

SPECIFIC DESCRIPTION

Figure 1:
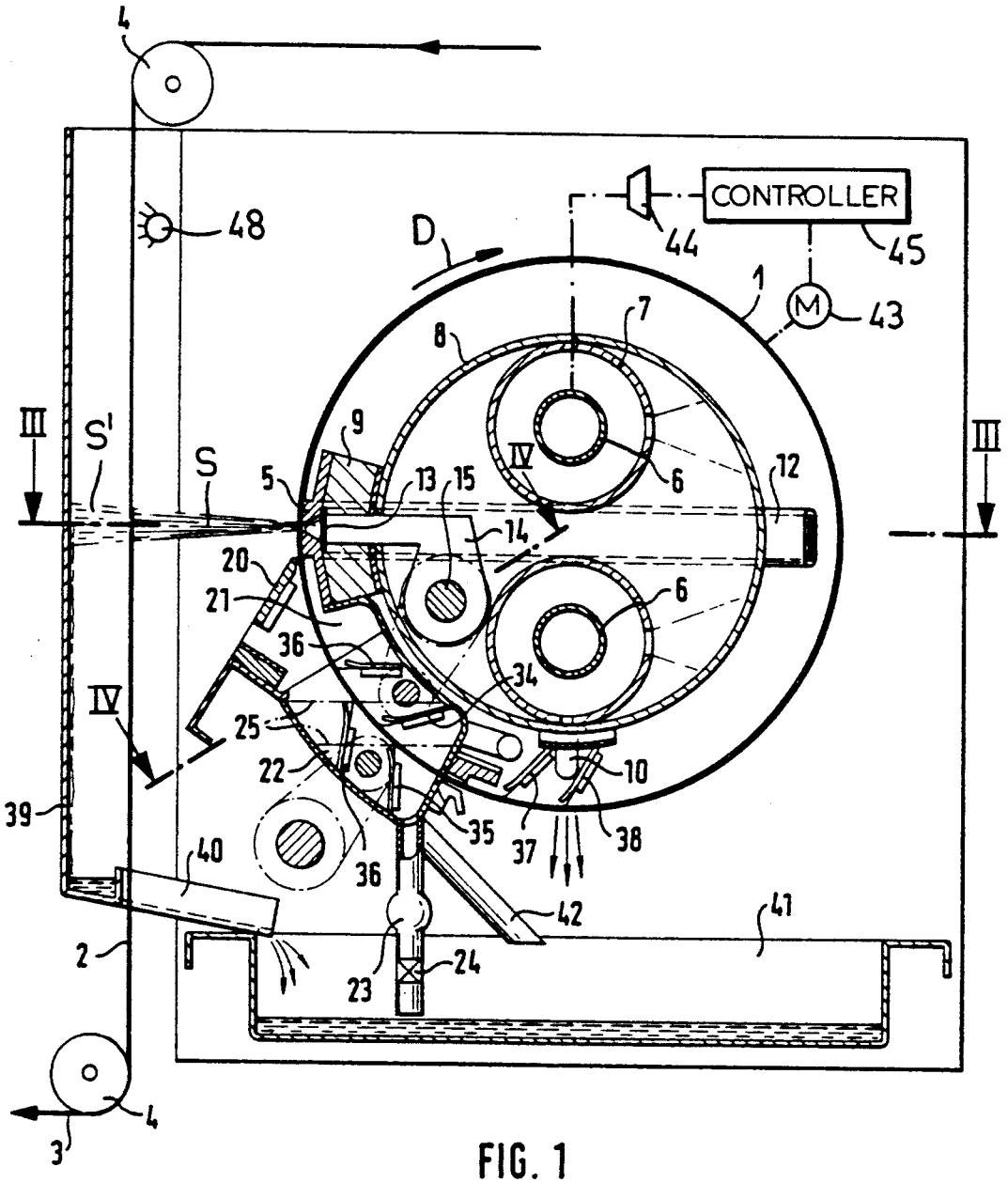
FIG. 1 is a partly diagrammatic vertical section through the apparatus of this invention with some parts omitted for clarity of view.
Figure 2:
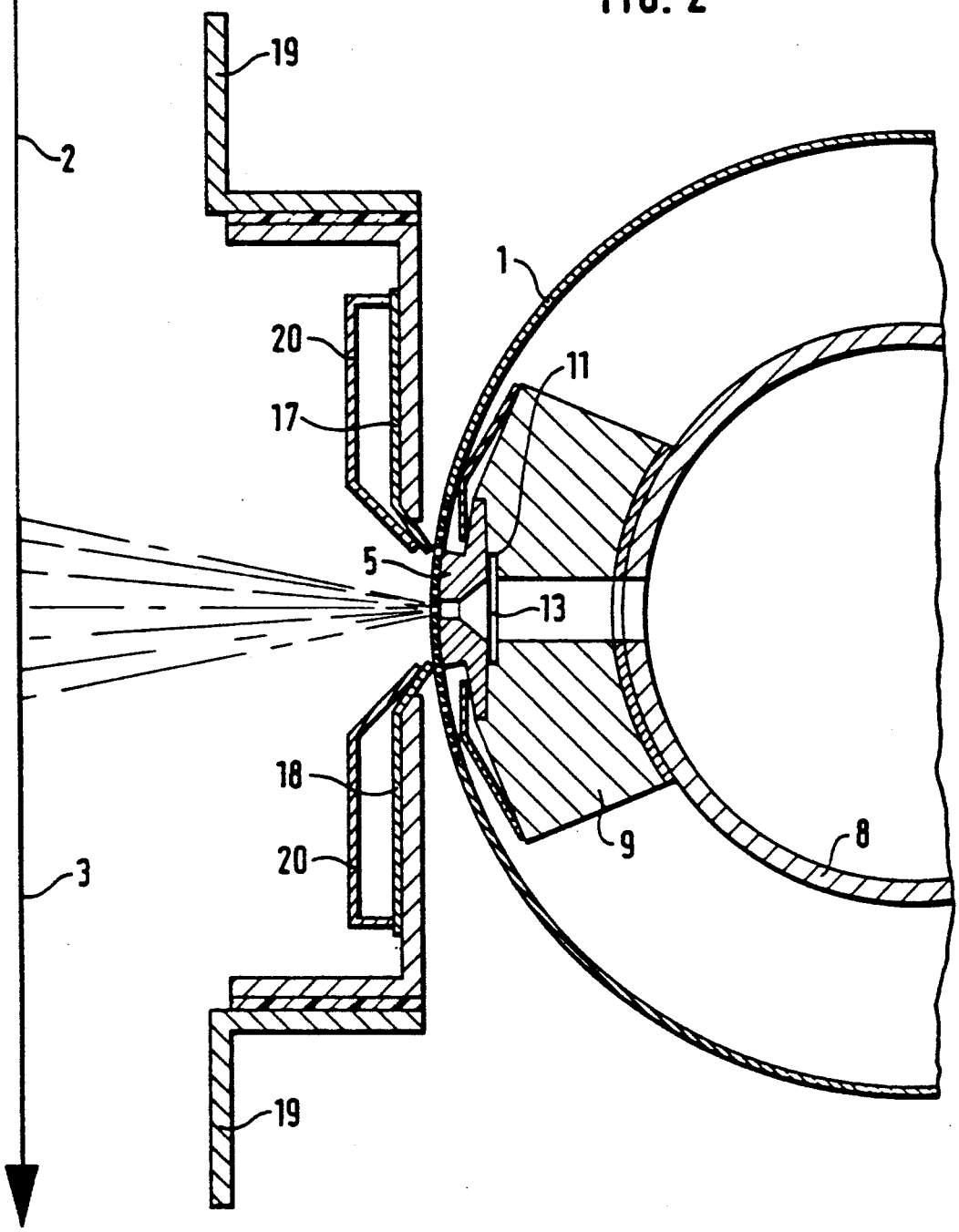
FIG. 2 is a large-scale view of a detail of FIG. 1.

As seen in FIGS. 1 through 4 a drum screen 1, here formed as a cylindrical tube of finely perforated metal whose perforations are only shown in one region in FIG. 2, is rotated about a central axis A by a drive motor 43 in rotation direction D. A workpiece web 2 passing over rollers 4 is pulled downward past the screen drum 1 in a transport direction 3 at a continuous rate. A sensor 48 detects the workpiece width.

A slot nozzle 5 inside the screen 1 has an opening extending substantially the full axial length of this screen 1 and is carried fixedly on mounts 9 in the housing 19 of the apparatus so as to face radially outward at the inside or back face of the screen 1 and through this screen 1 directly at the passing workpiece 2. The nozzle 5 is supplied with compressed gas from a source 44 through input pipes 6 that open into equalizing chambers 7 that in turn open into a large closed chamber 8 attached to the mounts 9 so that all gas in the chamber 8 must exit from it through the nozzle 5. A trap 10 is provided for condensate inside the chamber 8.

Figure 3:
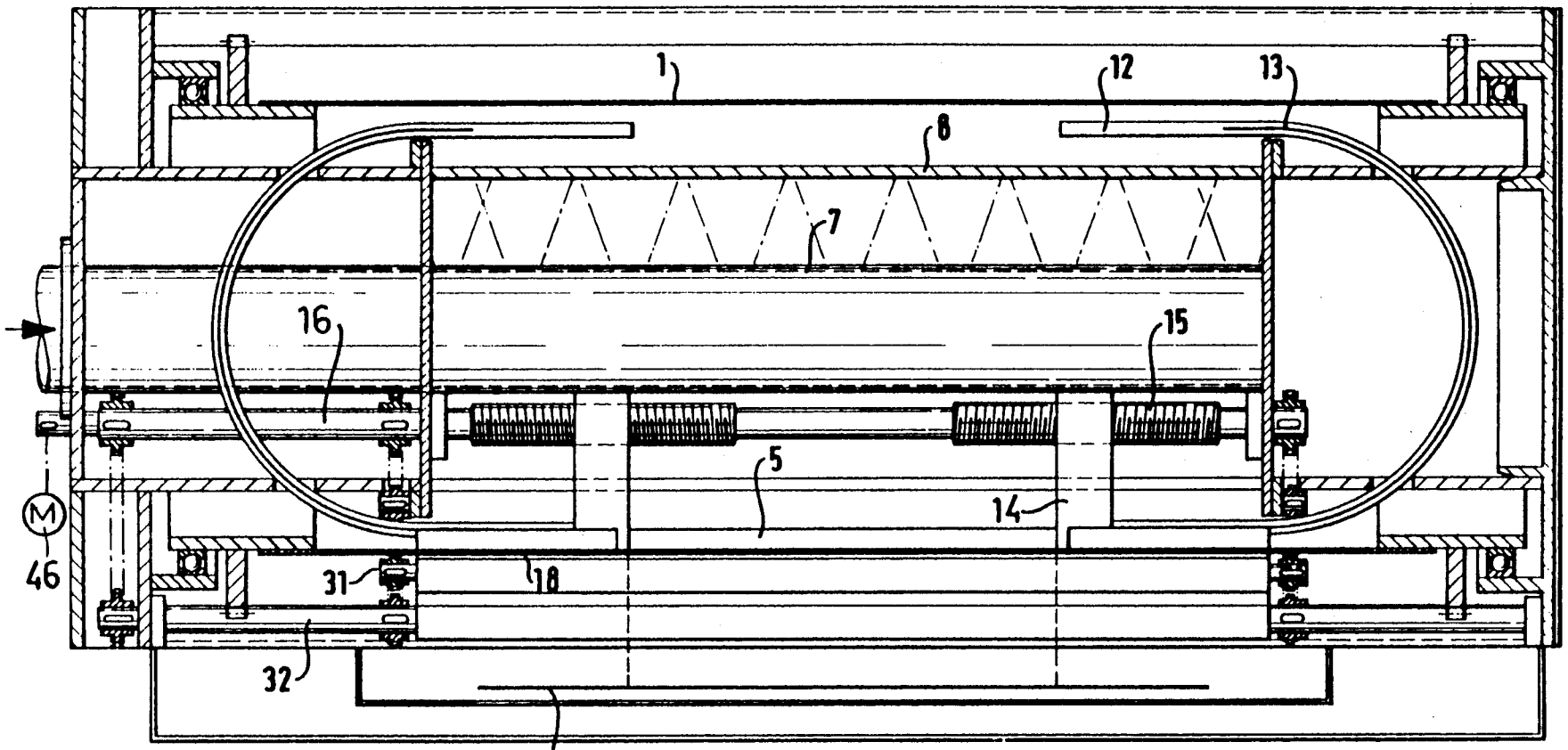
FIGS. 3 and 4 are sections taken respectively along lines III—III and IV—IV of FIG. 1.

The nozzle 5 is formed as a longitudinal guide 11 for two identical flexible metal strips 13 that also run in backwardly extending C-shaped guides 12 (see FIG. 3). The front ends of these strips 13 are connected to brackets 14 carried on oppositely threaded portions 15 of a drive shaft 16 that can be rotated in one direction to move the strips 13 toward each other and reduce the axial or longitudinal length of the nozzle 5 or apart to increase it.

FIG. 2 shows how scrapers 17 and 18 that are immediately upstream and downstream of the nozzle 5 in the direction D press the back or inner face of the screen 1 against the nozzle 5. These scrapers 17 and 18 are flexible and are pressed by holders 20 fixed to the housing 19 of the machine.

Troughs 21 and 22 inside and outside the screen 1 form therewith chambers filled to levels indicated at 25 with liquid drawn by a pump 23 through a pipe 23 from a supply or sump 41. The ends of these troughs 21 and 22 drain via pipes 42 into this sump 41 but the pipes 24 open into the longitudinal centers of them.

Figure 4:
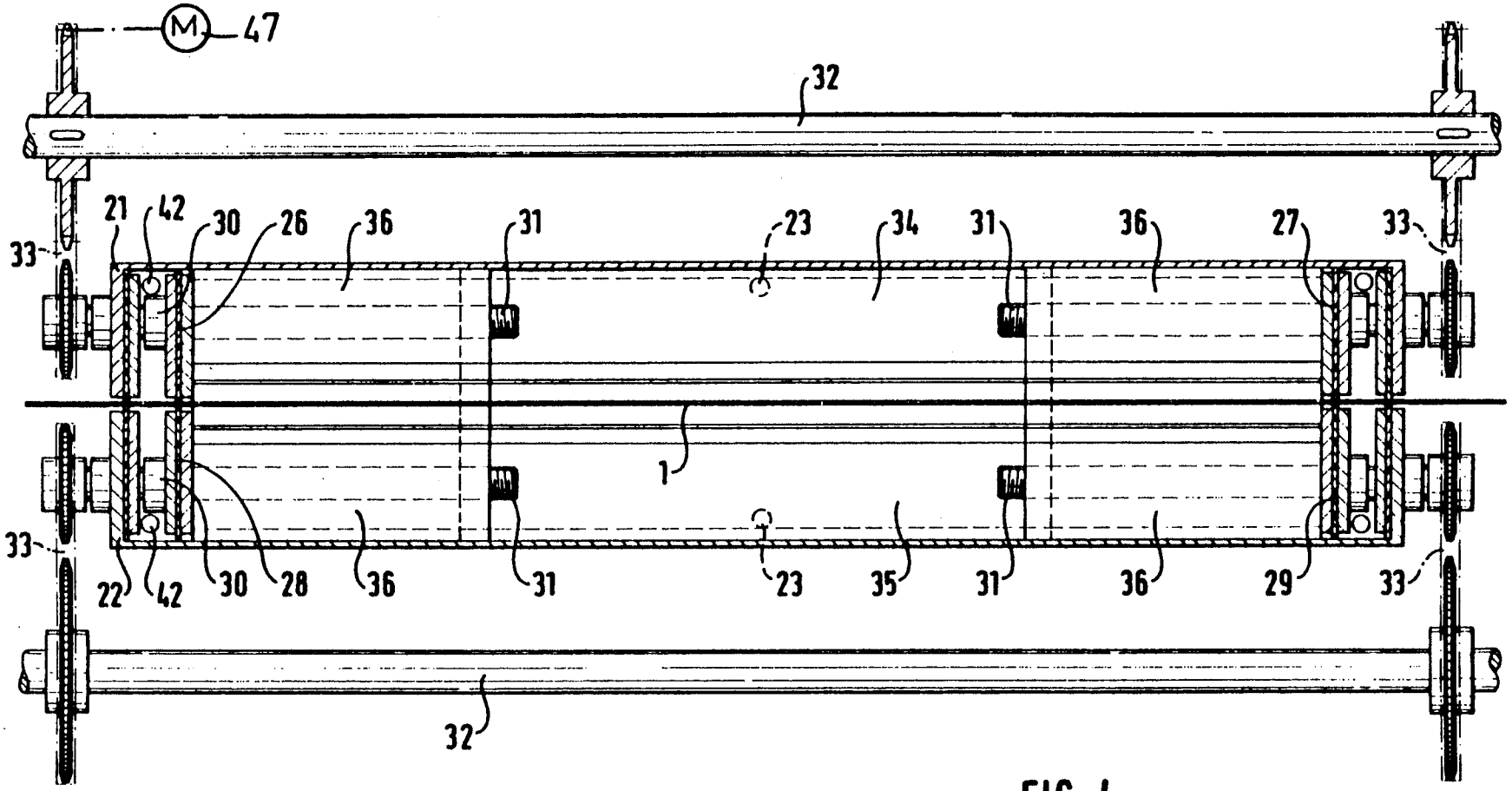

FIG. 4 clearly indicates how the effective length of the chamber formed by the troughs 21 and 22 is defined by respective pairs of pistons 26, 27 and 28, 29 carried on respective nuts 30 in turn carried on threaded spindles 31 connected via transmission chains 33 to synchronously driven drive shafts 32. A common controller 45 also connected to the pump 23, to the compressor 44, to the motor 43, to the sensor 48, and to a motor 46 that drives the shaft 16 operates a motor 47 that drives these shafts 32 synchronously. Thus the controller 45 can determine the spacing of each piston 26 and 28 from its mate piston 27 and 29 to determine just how wide a strip of the screen 1 will be wetted by the liquid in the troughs 21 and 22 in accordance with detected workpiece width.

Each trough 21 and 22 is provided fixed in its center with a respective scraper 34 and 35 that rubs the respective side of the screen 1 and forces the liquid through the perforations in it, simultaneously forcing out any hardened material and/or air bubbles. Further scrapers 36 carried on the pistons 26 through 29 ensure that the lateral regions of the screen 1 not reached by the middle scrapers 34 and 35 will be similarly scraped even when the system is at a wide setting. Scrapers 37 and 38 cover the full length of the interior of the drum 1 somewhat upstream in the direction D from the scrapers 34 through 36.

During normal operation the nozzle length is set by appropiately positioning the shutter strips 13 to be substantially equal to or perhaps a small bit longer than the spacing between the pistons 26 and 28 on one side and the pistons 27 and 29 on the other. Thus the screen 1 will be internally and internally thoroughly wetted immediately upstream of where it contacts the nozzle 5 along an accurately defined circumferential strip. As the screen 1 passes over the nozzle 5 air or steam exiting from it at high speed will drive the picked-up liquid from the interstices of the screen 1 and onto the passing web 2 as indicated by spray S. Any overspray as indicated at S' will strike an intercepting plate 39, and run down a channel 40 into the sump 41. The only region of the screen that will be wetted and through which gas will be blown will be that region necessary to wet the desired-width region of the workpiece 2, so that clogging of the screen 1 or wasting of the liquid is largely avoided.

I claim:

1. An apparatus for continuously applying a liquid to a web, the apparatus comprising:

a nozzle having an elongated opening and directed at the web;

a strip slidable steplessly along the opening of the nozzle to vary the length thereof;

a foraminous transfer screen displaceable transversely between the web and the nozzle opening and having a back face turned toward the nozzle and a front face turned toward the web;

longitudinally extending scrapers flanking the nozzle and pressing the back face of the screen against the nozzle;

back and front troughs engaging the respective faces of the screen and defining therewith back and front chambers;

respective back and front steplessly displaceable pistons in the troughs, engaging the respective screen faces, and each defining an end wall for the respective chamber;

supply means for filling the chambers with a treatment liquid, whereby the liquid will wet the respective face of the screen over an area determined by the position of the pistons;

means for supplying a gas to the nozzle to blow the gas through the nozzle opening and through the screen and thereby transfer liquid carried by the screen to the web; and control means connected to the pistons and to the strip for varying the lengths of the chambers and nozzle opening.

2. The liquid-applying apparatus defined in claim 1 wherein each of the troughs is provided with two such pistons defining respective end walls, the nozzle being provided with two such strips, the apparatus further comprising respective transmission means connected between the pistons of each chamber and between the strips for longitudinally oppositely moving the respective pistons and strips.

3. The liquid-applying apparatus defined in claim 2 wherein the transmission means are all interconnected for substantially synchronous movement of the pistons and strips.

4. The liquid-applying apparatus defined in claim 2 wherein the transmission means includes a front threaded spindle engaging through the pistons of the front trough and a rear threaded spindle engaging through the pistons of the rear trough.

5. The liquid-applying apparatus defined in claim 2 wherein the nozzle is formed with a guide slot in which the strips are displaceable, the transmission means including a threaded strip spindle operatively engaged with the strips.

6. The liquid-applying apparatus defined in claim 1, further comprising respective front and back scrapers in the front and rear trough engaging the respective faces of the screen.

7. The liquid-applying apparatus defined in claim 6 wherein the screen is formed as an endless loop, the apparatus further comprising means for continuously advancing the screen in a screen-travel direction generally parallel to the web past the nozzle.

8. The liquid applying apparatus defined in claim 7 wherein the scrapers are offset from one another relative to the screen-travel direction.

9. The liquid-applying apparatus defined in claim 7 wherein the troughs are immediately upstream of the nozzle in the screen-travel direction.

10. The liquid-applying apparatus defined in claim 1 wherein the supply means includes means for maintaining the chambers full to predetermined respective depths with the liquid.

* * * * *